US009797189B2

(12) United States Patent
Huang et al.

(10) Patent No.: US 9,797,189 B2
(45) Date of Patent: Oct. 24, 2017

(54) CORDLESS WINDOW SHADE AND SPRING DRIVE SYSTEM THEREOF

(71) Applicant: TEH YOR CO., LTD., Taipei (TW)

(72) Inventors: Chin-Tien Huang, New Taipei (TW); Fu-Lai Yu, New Taipei (TW)

(73) Assignee: TEH YOR CO., LTD., Taipei (TW)

( * ) Notice: Subject to any disclaimer, the term of this patent is extended or adjusted under 35 U.S.C. 154(b) by 0 days.

(21) Appl. No.: 14/932,060

(22) Filed: Nov. 4, 2015

(65) Prior Publication Data

US 2016/0123071 A1 May 5, 2016

Related U.S. Application Data

(60) Provisional application No. 62/075,339, filed on Nov. 5, 2014.

(51) Int. Cl.

| | |
|---|---|
| ***E06B 9/30*** | (2006.01) |
| ***E06B 9/386*** | (2006.01) |
| ***E06B 9/384*** | (2006.01) |
| ***E06B 9/262*** | (2006.01) |
| ***E06B 9/322*** | (2006.01) |

(52) U.S. Cl.

CPC ..... *E06B 9/30* (2013.01); *E06B 9/262* (2013.01); *E06B 9/322* (2013.01); *E06B 9/384* (2013.01); *E06B 9/386* (2013.01); *E06B 2009/2627* (2013.01); *E06B 2009/3222* (2013.01)

(58) Field of Classification Search

CPC ..... E06B 2009/3222; E06B 9/322; E06B 2009/3225; E06B 9/262; E06B 2009/2627; E06B 2009/2625; B60R 2022/4453

USPC ..... 242/372

See application file for complete search history.

(56) References Cited

U.S. PATENT DOCUMENTS

| | | | |
|---|---|---|---|
| 5,531,257 | A | 7/1996 | Kuhar |
| 6,012,506 | A | 1/2000 | Wang et al. |
| 6,024,154 | A | 2/2000 | Wang et al. |

(Continued)

FOREIGN PATENT DOCUMENTS

| | | | |
|---|---|---|---|
| CN | 203701911 | U | 7/2014 |
| DE | 202013101290 | U1 | 4/2013 |

(Continued)

OTHER PUBLICATIONS

The Office Action issued on Aug. 1, 2016 and cited references in co-pending TW Patent Application No. 104136390.

(Continued)

*Primary Examiner* — Katherine Mitchell
*Assistant Examiner* — Jeremy Ramsey
(74) *Attorney, Agent, or Firm* — Baker & McKenzie LLP; David I. Roche

(57) ABSTRACT

A spring drive system for a cordless window shade includes multiple rotary drums respectively connected with suspension cords, and one or more springs respectively connected with the rotary drums. The rotary drums are operatively connected with each other, so that they can synchronously rotate to wind and unwind the suspension cords. Moreover, each of the rotary drums is connected with an end of one spring. The spring torque can act to sustain a bottom part of the window shade at any desired height, and drive rotation of the rotary drums to wind the suspension cords when the bottom rail is raised upward.

11 Claims, 21 Drawing Sheets

(56) References Cited

U.S. PATENT DOCUMENTS

| | | | | |
|---|---|---|---|---|
| 6,283,192 | B1 | 9/2001 | Toti | |
| 6,289,965 | B1 | 9/2001 | Ruggles | |
| 6,318,661 | B1 | 11/2001 | Martin et al. | |
| 6,330,899 | B1 | 12/2001 | Ciuca et al. | |
| 6,508,293 | B1 * | 1/2003 | Huang | E06B 9/322 160/170 |
| 6,644,372 | B2 | 11/2003 | Judkins | |
| 6,644,375 | B2 | 11/2003 | Palmer | |
| 6,761,203 | B1 * | 7/2004 | Huang | E06B 9/322 160/170 |
| 7,093,644 | B2 | 8/2006 | Strand | |
| 8,297,332 | B2 | 10/2012 | Lin | |
| 2004/0250965 | A1 * | 12/2004 | Strand | E06B 9/322 160/170 |
| 2006/0096719 | A1 * | 5/2006 | Wu | E06B 9/388 160/170 |
| 2006/0196612 | A1 | 9/2006 | Strand | |
| 2008/0000592 | A1 * | 1/2008 | Huang | E06B 9/322 160/170 |
| 2008/0185109 | A1 * | 8/2008 | Lin | E06B 9/262 160/170 |
| 2011/0061823 | A1 * | 3/2011 | Lin | E06B 9/262 160/340 |
| 2012/0138724 | A1 | 6/2012 | Chen et al. | |
| 2012/0280072 | A1 | 11/2012 | Lin | |
| 2013/0032300 | A1 * | 2/2013 | Yu | E06B 9/322 160/84.02 |
| 2013/0233499 | A1 * | 9/2013 | Wu | E06B 9/322 160/218 |
| 2014/0083631 | A1 * | 3/2014 | Huang | E06B 9/322 160/170 |
| 2015/0129142 | A1 * | 5/2015 | Huang | E06B 9/262 160/370 |
| 2015/0176329 | A1 * | 6/2015 | Chen | E06B 9/322 160/176.1 R |
| 2015/0354271 | A1 * | 12/2015 | Hsu | E06B 9/322 160/173 R |

FOREIGN PATENT DOCUMENTS

| | | | |
|---|---|---|---|
| TW | 380044 | A4 | 8/1987 |
| TW | 201307667 | A1 | 2/2013 |

OTHER PUBLICATIONS

An English translation of the Abstract of TW 201307667. (Note that the English translation of the Abstract for TW 380044 is found on p. 3 of the patent.)

The International Search Report and Written Opinion in co-pending PCT Application No. PCT/US2015/058994, which was issued on Feb. 24, 2016.

The Office Action dated Jan. 3, 2017 in corresponding CN Patent Application No. 201510743053.7.

An English Translation of the Abstract for CN 203701911 U.

* cited by examiner

CORDLESS WINDOW SHADE AND SPRING DRIVE SYSTEM THEREOF

CROSS-REFERENCE TO RELATED APPLICATION(S)

This application claims priority to U.S. Provisional Patent Application No. 62/075,339 filed on Nov. 5, 2014, the disclosure of which is incorporated herein by reference.

BACKGROUND

1. Field of the Invention

The present inventions relate to cordless window shades, and spring drive systems used in cordless window shades.

2. Description of the Related Art

Many types of window shades are currently available on the market, such as Venetian blinds, roller shades and honeycomb shades. The shade when lowered can cover the area of the window frame, which can reduce the amount of light entering the room through the window and provided increased privacy. Conventionally, the window shade is provided with an operating cord that can be manually actuated to raise or lower a bottom rail of the window shade. The bottom rail can be raised by winding a suspension member around a rotary drum, and lowered by unwinding the suspension member from the rotary drum.

However, there have been concerns that the operating cord of the window shade may pose strangulation threat to children. As a result, cordless window shades have been developed, which use electric motors or spring motors to raise and lower the bottom rail. Spring motors used in window shades generally consist of springs that are operable to apply a torque for keeping the bottom rail at a desired height. However, the conventional assemblies of the spring motors are usually complex, and require multiple moving parts to transmit the spring torque to the rotary drum. This may increase the weight of the spring motor that is provided in the cordless window shade.

Therefore, there is a need for a cordless window shade that has an improved drive system, and can address at least the foregoing issues.

SUMMARY

The present application describes a cordless window shade and a spring drive system for use with the cordless window shade. In one embodiment, the spring drive system includes a housing, a first and a second rotary drum, a first through third gear, a first and a second spool, and a first and a second spring. The first rotary drum is affixed with the first gear and is pivotally connected with the housing, the first rotary drum being connected with a first suspension cord. The second rotary drum is affixed with the second gear and is pivotally connected with the housing, the second rotary drum being connected with a second suspension cord. The third gear is pivotally connected with the housing, the third gear being respectively meshed with the first and second gears. The first and second spools are respectively pivotally connected at two opposite sides of the third gear, the first and second spools being arranged coaxial to the third gear and respectively rotatable relative to the third gear. The first spring has a first and a second end respectively anchored with the first rotary drum and the first spool, and the second spring has a third and a fourth end respectively anchored with the second rotary drum and the second spool. The first and second springs respectively unwind from the first and second spools and respectively wind around the first and second rotary drums when the first and second rotary drums rotate to respectively unwind the first and second suspension cords therefrom, and the first and second springs respectively unwind from the first and second rotary drums and respectively wind around the first and second spools to drive respective rotations of the first and second rotary drums for respectively winding the first and second suspension cords.

According to another embodiment, the spring drive system includes a housing, a first and a second rotary drum, a first and a second gear, a spool and a spring. The first rotary drum is affixed with a first gear and is pivotally connected with the housing, the first rotary drum being connected with a first suspension cord. The second rotary drum is affixed with a second gear and is pivotally connected with the housing, the second gear being meshed with the first gear, and the second rotary drum being connected with a second suspension cord. The spool is pivotally connected with the housing coaxial to the first rotary drum, the spool being rotatable relative to the first rotary drum. The spring has a first and a second end respectively anchored with the spool and the second rotary drum. The spring unwinds from the spool and winds around the second rotary drum when the first and second rotary drums rotate to respectively unwind the first and second suspension cords therefrom, and the spring unwinds from the second rotary drum and winds around the spool to drive respective rotations of the first and second rotary drums for respectively winding the first and second suspension cords.

DETAILED DESCRIPTION OF THE EMBODIMENTS

Figure 1:
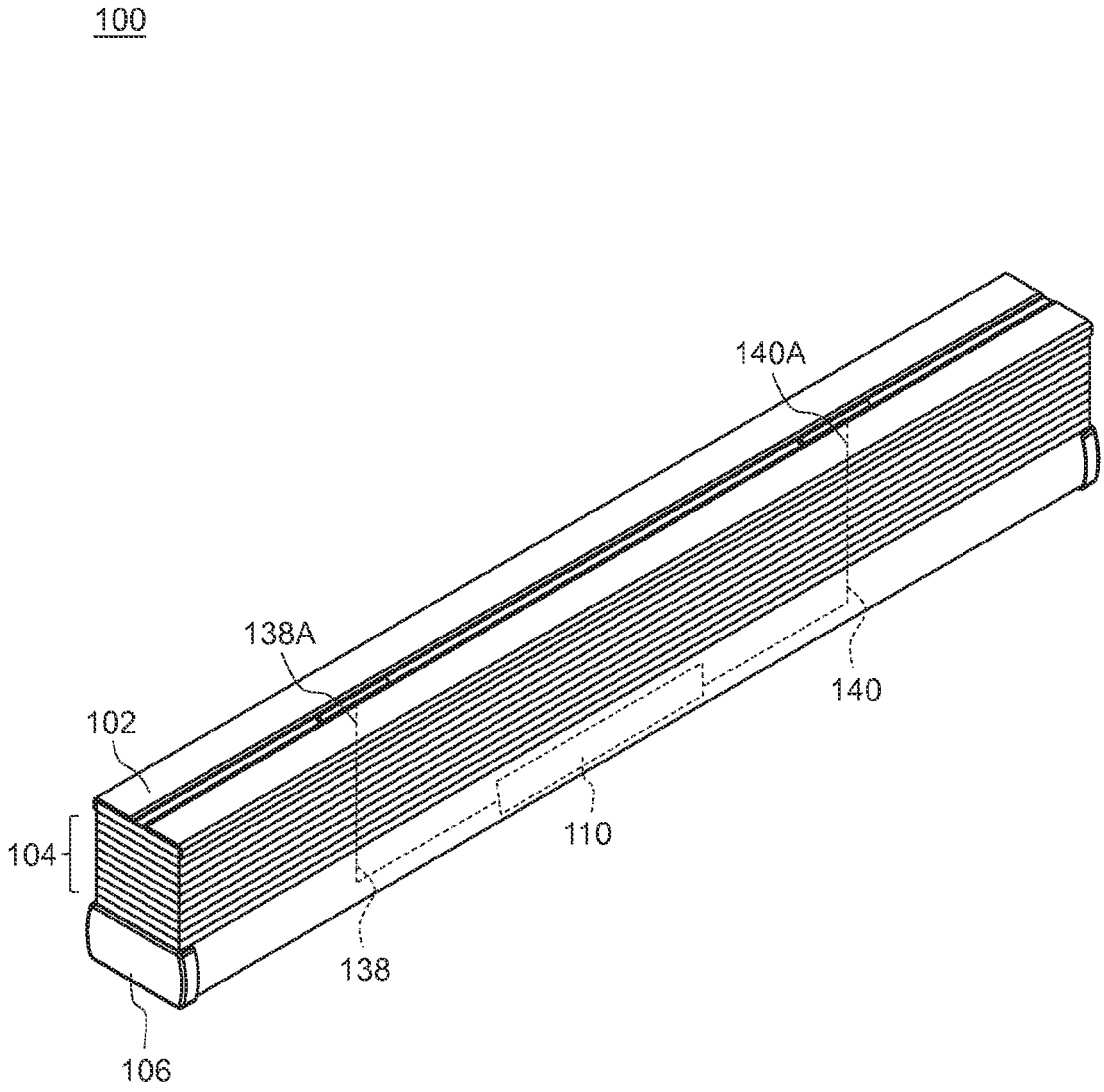
FIG. 1 is a perspective view illustrating an embodiment of a cordless window shade.
Figure 2:
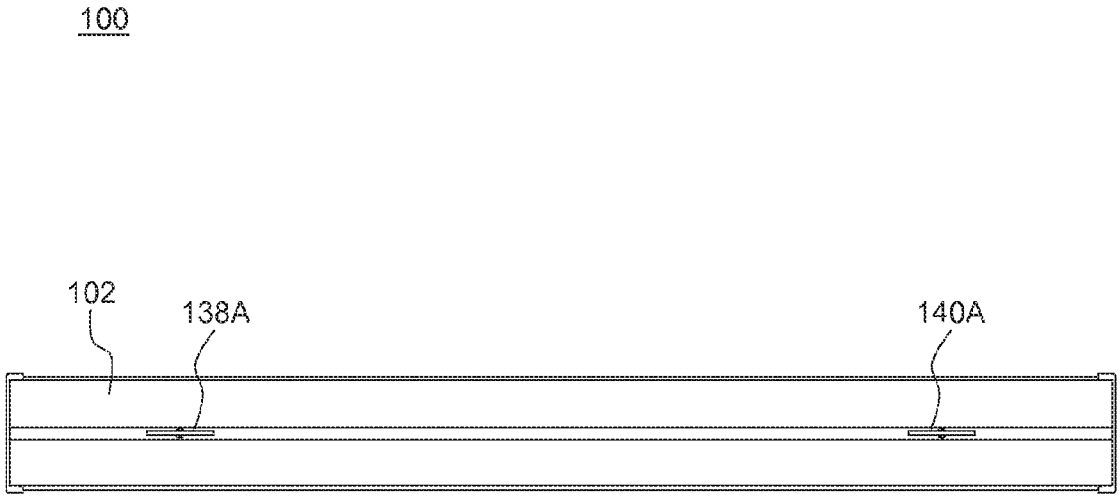
FIG. 2 is top view of the cordless window shade shown in FIG. 1.
Figure 3:
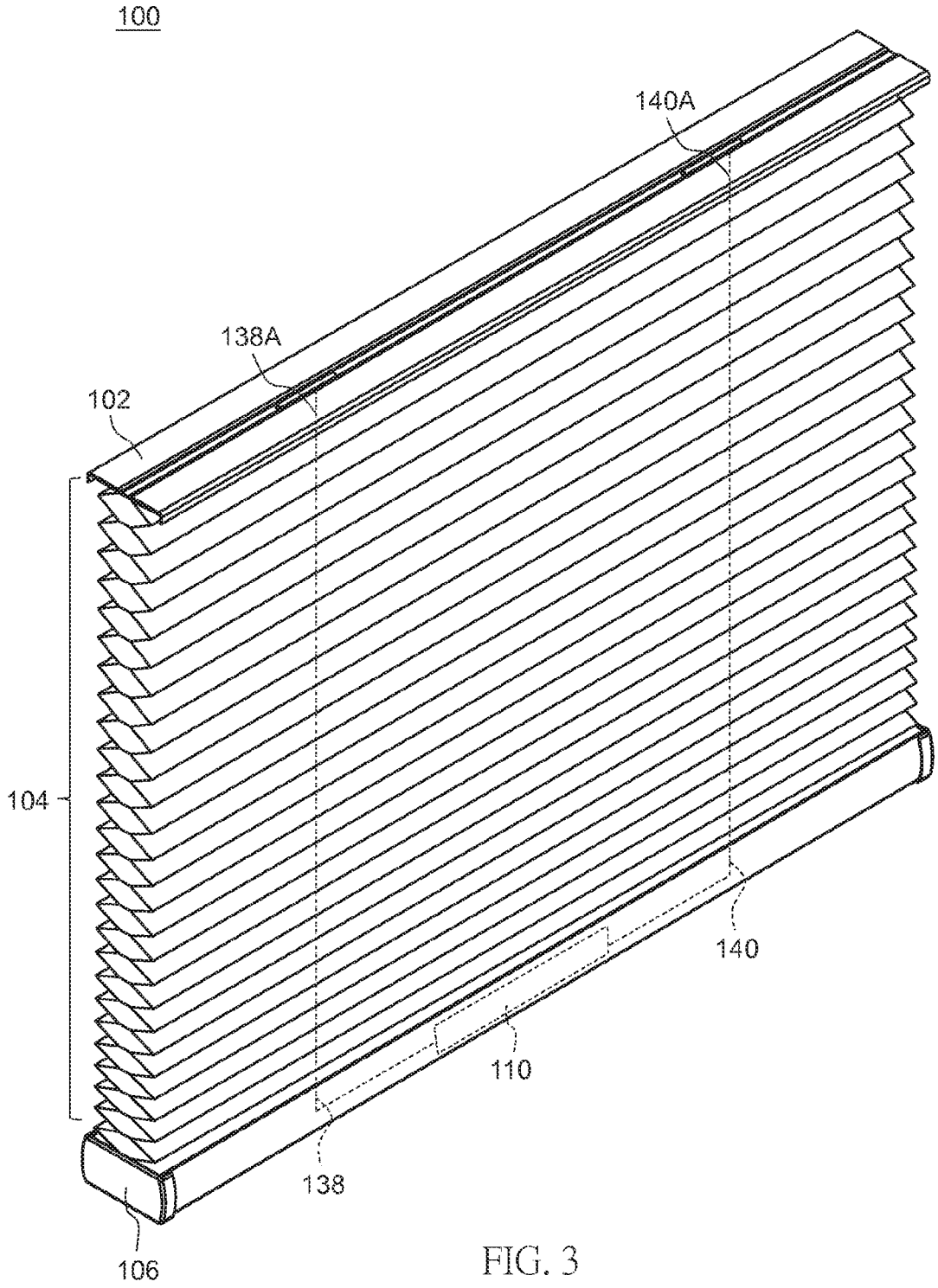
FIG. 3 is a schematic view illustrating the cordless window shade of FIG. 1 in a fully expanded or lowered state.

FIG. 1 is a perspective view illustrating an embodiment of a cordless window shade 100, FIG. 2 is a top view illustrating the window shade 100, and FIG. 3 is a schematic view illustrating the window shade 100 in a fully expanded or lowered state. "Cordless window shade" as used herein means a window shade having no operating cord exposed for a user's operation. The window shade 100 includes a head rail 102, a shading structure 104, and a bottom part 106 disposed at a bottom of the shading structure 104. The head rail 102 may be of any types and shapes. The head rail 102 may be affixed at a top of a window frame, and the shading structure 104 and the bottom part 106 can be suspended from the head rail 102.

The shading structure 104 can have any suitable constructions. For example, the shading structure 104 can include a honeycomb structure made from a cloth material (as shown), a Venetian blind construction, or a plurality of slats distributed vertically and parallel to one another.

The bottom part 106 is disposed at a bottom of the window shade 100, and is movable vertically relative to the head rail 102 to expand and collapse the shading structure 104. In one embodiment, the bottom part 106 may be formed as an elongated rail. However, any types of weighing structures may be suitable. In some embodiment, the bottom part 106 may also be formed by a lowermost portion of the shading structure 104. Moreover, the bottom part 106 can have an inner cavity in which a spring drive system 110 can be assembled for sustaining the shading structure 104 and the bottom part 106 at any desirable height.

Figure 4:
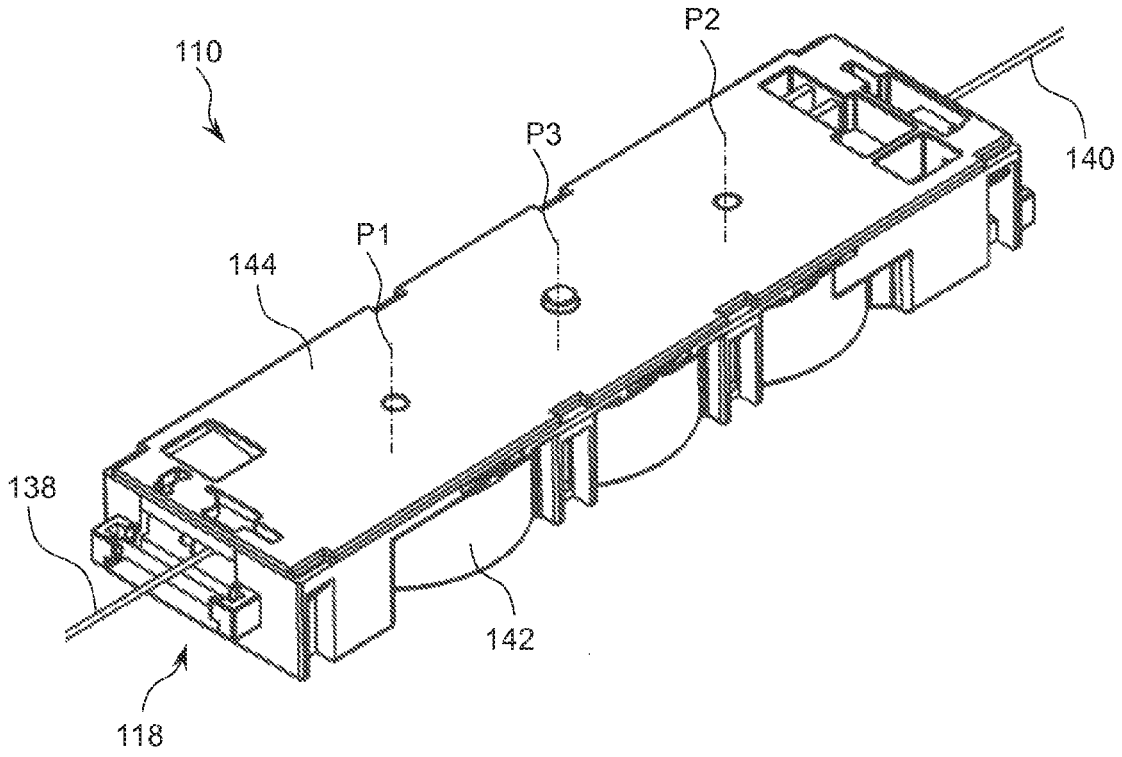
FIG. 4 is a perspective view illustrating a spring drive system used in the cordless window shade shown in FIGS. 1-3.
Figure 5:
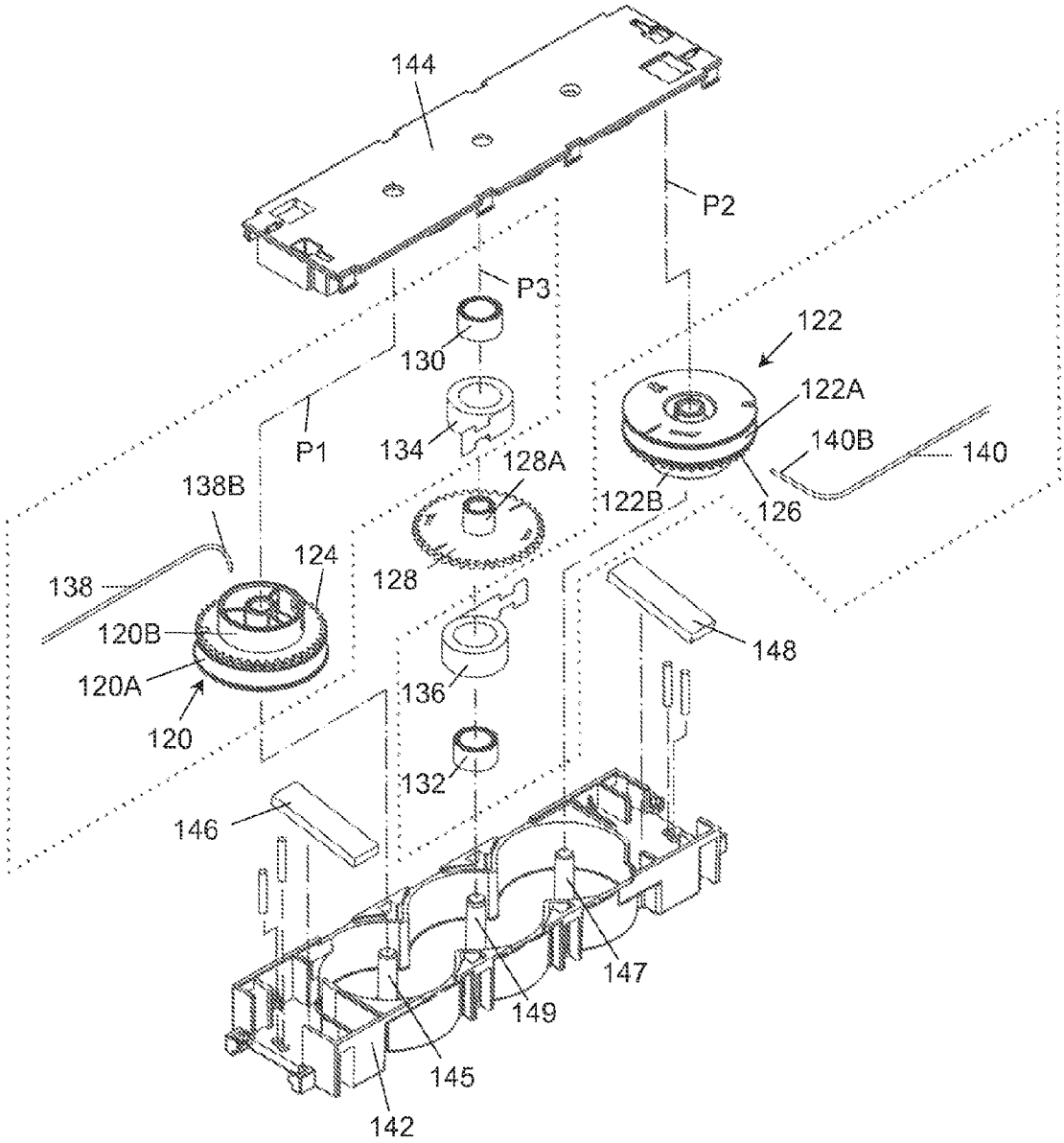
FIG. 5 is an exploded view of the spring drive system shown in FIG. 4.
Figure 6:
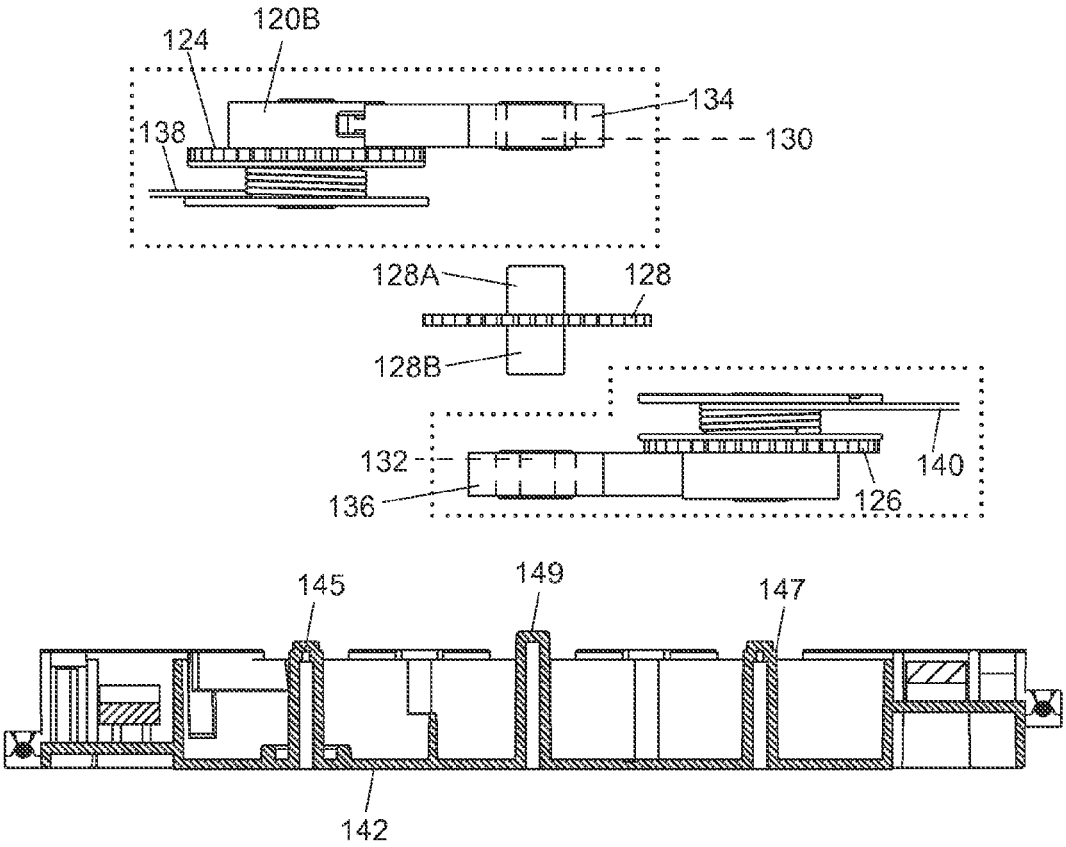
FIG. 6 is schematic view illustrating the construction of the spring drive system shown in FIG. 4.
Figure 7:
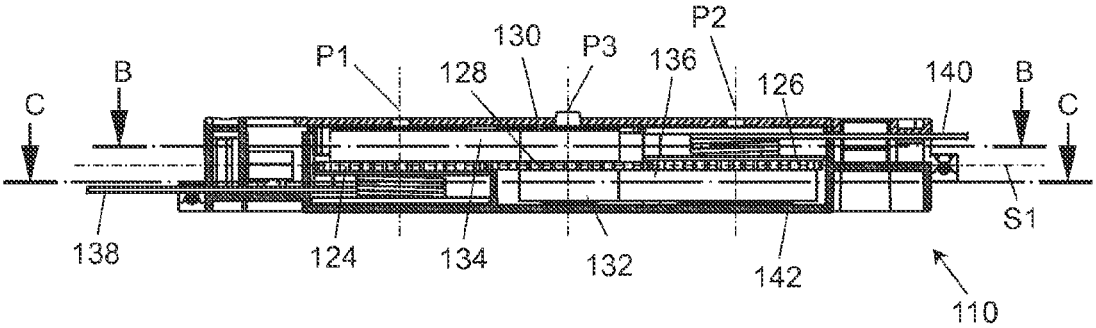
FIG. 7 is a cross-sectional view illustrating the spring drive system shown in FIG. 4.

FIG. 4 is a perspective view illustrating the spring drive system 110, FIG. 5 is an exploded view of the spring drive system 110, FIG. 6 is schematic view illustrating the construction of the spring drive system 110, and FIG. 7 is a cross-sectional view of the spring drive system 110. Referring to FIGS. 4-7, the spring drive system 110 arranged in the bottom part 106 can include a housing 118, two rotary drums 120 and 122, a plurality of gears 124, 126 and 128, two spools 130 and 132, two springs 134 and 136, and two suspension cords 138 and 140. The housing 118 can be affixed with the bottom part 106, and can be formed by a casing 142 and a lid 144. The casing 142 can have an inner cavity in which are respectively placed the rotary drums 120 and 122, the gears 124, 126 and 128, the spools 130 and 132 and the springs 134 and 136.

The rotary drum 120 is affixed with the gear 124, and has two drum surfaces 120A and 120B at two opposite sides of the gear 124. The rotary drum 120 and the gear 124 can be pivotally connected with the housing 118 coaxially about a shaft 145 that is affixed with the casing 142. The shaft 145 can thereby define a pivot axis P1 about which the rotary drum 120 and the gear 124 can rotate in unison relative to the housing 118.

The rotary drum 122 is affixed with the gear 126, and has two drum surfaces 122A and 122B at two opposite sides of the gear 126. The rotary drum 122 and the gear 126 can be pivotally connected with the housing 118 coaxially about a shaft 147 that is affixed with the casing 142 spaced apart from the shaft 145. The shaft 147 can thereby define a pivot axis P2 about which the rotary drum 122 and the gear 126 can rotate in unison relative to the housing 118.

The gear 128 can be affixed with two shaft portions 128A and 128B (better shown in FIG. 6) projecting at two opposite sides thereof. The gear 128 and the shaft portions 128A and 128B are pivotally connected with the housing 118 coaxially about a shaft 149 that is affixed with the casing 142, and the gear 128 is respectively meshed with the two gears 124 and 126. The shaft 149 can thereby define a pivot axis P3 about which the gear 128 and the shaft portions 128A and 128B can rotate in unison relative to the housing 118. In one embodiment, the gear 128 can be respectively meshed with the two gears 124 and 126 in a common plane S1, and the pivot axes P1, P2 and P3 can be substantially aligned along a same line L. The respective drum surfaces 120A and 122B of the rotary drums 120 and 122 can be located at a first side of the common plane S1, and the drum surfaces 120B and 122A of the rotary drums 120 and 122 can be located at an opposite second side of the common plane S1.

The two spools 130 and 132 can be pivotally connected at two opposite sides of the gear 128 about the shaft portions 128A and 128B, respectively. The spools 130 and 132 are thereby arranged coaxial to the gear 128, and can respectively rotate independently about the pivot axis P3 relative to the gear 128 and the housing 118.

The suspension cord 138 vertically passes through the shading structure 104, and has two opposite ends 138A and 138B respectively anchored with the head rail 102 and the drum surface 120A of the rotary drum 120. The suspension cord 140 likewise vertically passes through the shading structure 104, and has two opposite ends 140A and 140B respectively anchored with the head rail 102 and the drum surface 122A of the rotary drum 122. The two suspension cords 138 and 140 can respectively extend from the two rotary drums 120 and 122 and respectively exit two opposite ends of the housing 118 at two opposite sides of the line L (better shown in FIG. 8A). Owing to the gear engagement of the two rotary drums 120 and 122 with the gear 128, the two rotary drums 120 and 122 can rotate in unison to respectively wind the suspension cords 138 and 140 in a synchronous manner, which correspond to a rise of the bottom part 106. Moreover, the two rotary drums 120 and 122 can also rotate synchronously to respectively unwind the suspension cords 138 and 140, which correspond to a lowering displacement of the bottom part 106.

The spring 134 can be a coiled ribbon spring, and can be assembled around the spool 130. The spring 134 can have two opposite ends respectively anchored with the drum surface 120B of the rotary drum 120 and the spool 130. Both the suspension cord 138 and the spring 134 thus are commonly connected with the rotary drum 120 at two opposite sides of the gear 124.

The spring 136 can be a coiled ribbon spring, and can be assembled around the spool 132. The spring 136 can have two opposite ends respectively anchored with the drum surface 122B of the rotary drum 122 and the spool 132. Both the suspension cord 140 and the spring 136 thus are commonly connected with the rotary drum 122 at two opposite sides of the gear 126.

The springs 134 and 136 can respectively unwind from the spools 130 and 132 and respectively wind around the respective drum surfaces 120B and 122B of the rotary drums 120 and 122 when the two rotary drums 120 and 122 rotate to respectively unwind the two suspension cords 138 and 140. Moreover, the two springs 134 and 136 can respectively unwind from the two rotary drums 120 and 122 and respectively wind around the two spools 130 and 132 to drive respective rotations of the two rotary drums 120 and 122 for respectively winding the two suspension cords 138 and 140.

Referring to FIG. 5, the spring drive system 110 can further include two tensioning plates 146 and 148 respectively arranged near the two rotary drums 120 and 122. The tensioning plates 146 and 148 can be biased (e.g., by gravity action or spring action) to respectively press on the two suspension cords 138 and 140, whereby the suspension cords 138 and 140 can be properly tensioned when they are wound around the rotary drums 120 and 122.

The spring drive system 110 as described herein can be arranged such that the gears 124, 126 and 128 are placed generally horizontally in the bottom part 106 and the pivot axes P1, P2 and P3 extend substantially vertical.

Figure 8A:
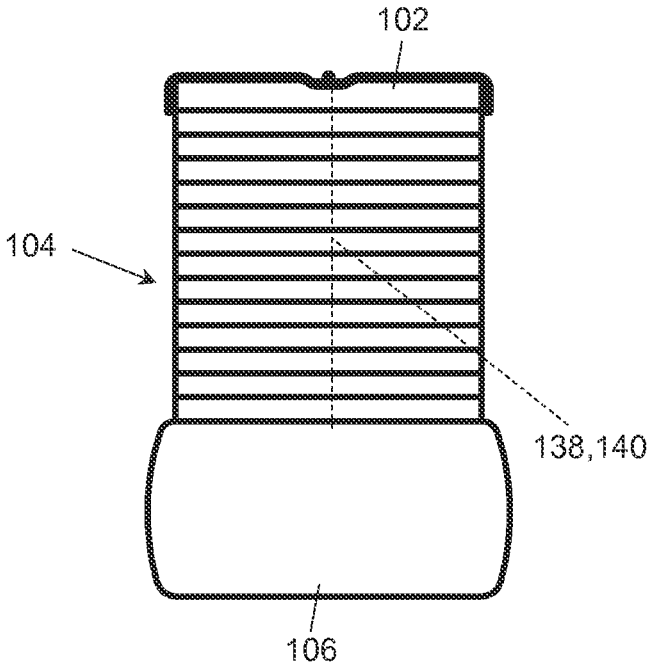
FIG. 8A is a schematic view illustrating the cordless window shade in a fully opened or raised state.
Figure 8B:
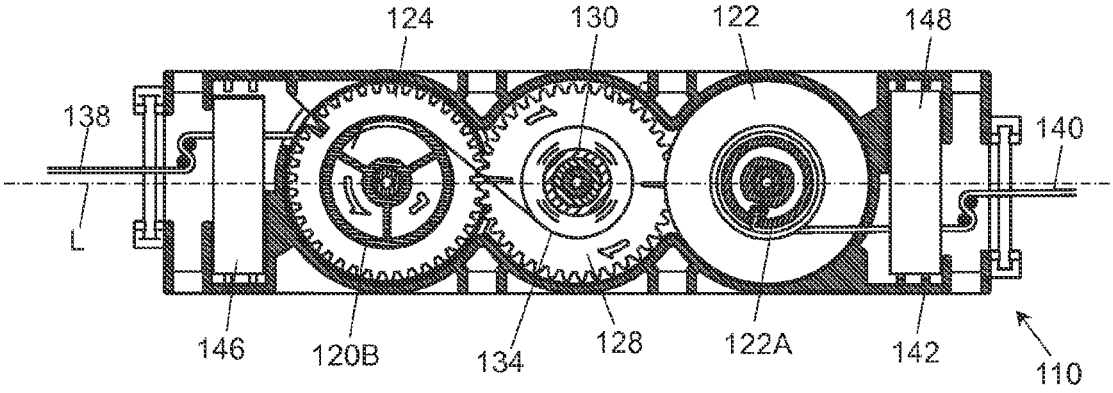
FIGS. 8B and 8C are cross-sectional views respectively taken along section B and C as shown in FIG. 7 illustrating the spring drive system in a state corresponding to the position of the window shade shown in FIG. 8A.
Figure 8C:
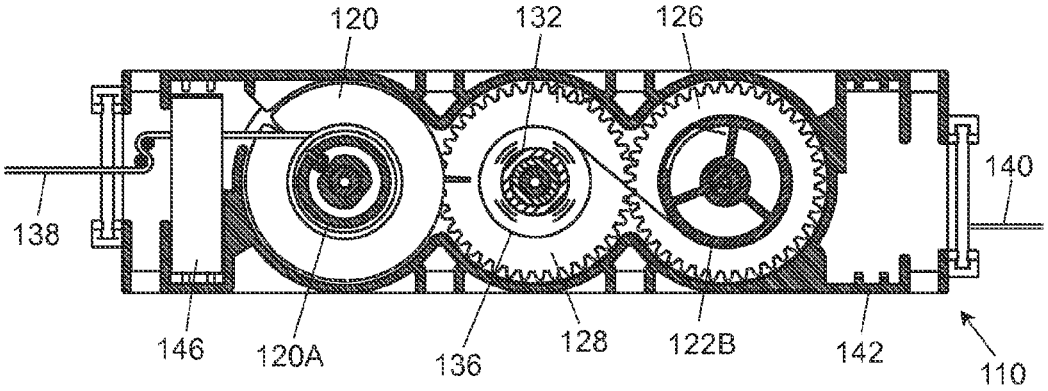

In conjunction with FIGS. 1-7, reference is hereinafter made to FIGS. 8A-10C to describe exemplary operation of the spring drive system 110 of the window shade 100. FIG. 8A is a schematic view illustrating the window shade 100 in a fully opened or raised state, and FIGS. 8B and 8C are cross-sectional views respectively taken along sections B and C as shown in FIG. 7 illustrating the spring drive system 110 in a state corresponding to the configuration of the window shade 100 shown in FIG. 8A. Referring to FIGS. 5-7 and 8A-8C, the window shade 100 is shown in a fully opened or raised state. In this state, the two suspension cords 138 and 140 are wound around the drum surfaces 120A and 122A of the rotary drums 120 and 122. Moreover, the two springs 134 and 136 are substantially wound around the respective spools 130 and 132, and unwound from the respective rotary drums 120 and 122. The biasing forces applied by the two springs 134 and 136 on the rotary drums 120 and 122 can counteract a weight exerted by the bottom part 106, so that the rotary drums 120 and 122 can be kept stationary. Accordingly, the bottom part 106 can remain in a stationary position close to the head rail 102, and the shading structure 104 can be collapsed between the head rail 102 and the bottom part 106.

Figure 9A:
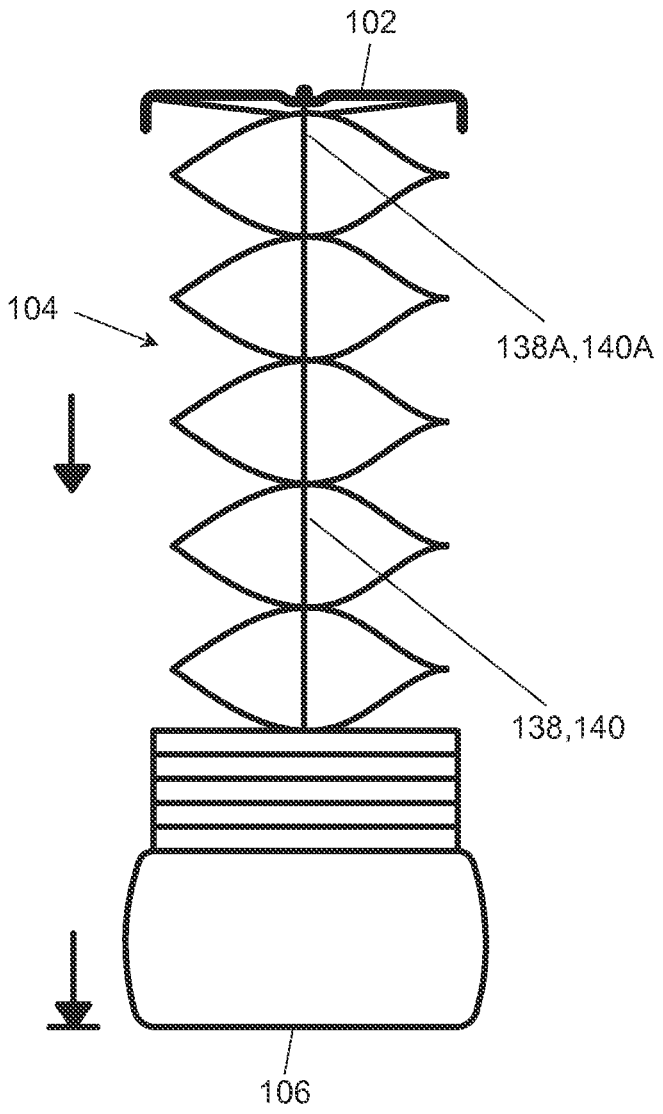
FIG. 9A is a schematic view illustrating the cordless window shade in another position in which the bottom part is vertically lowered away from the head rail to expand at least partially the shading structure.
Figure 9B:
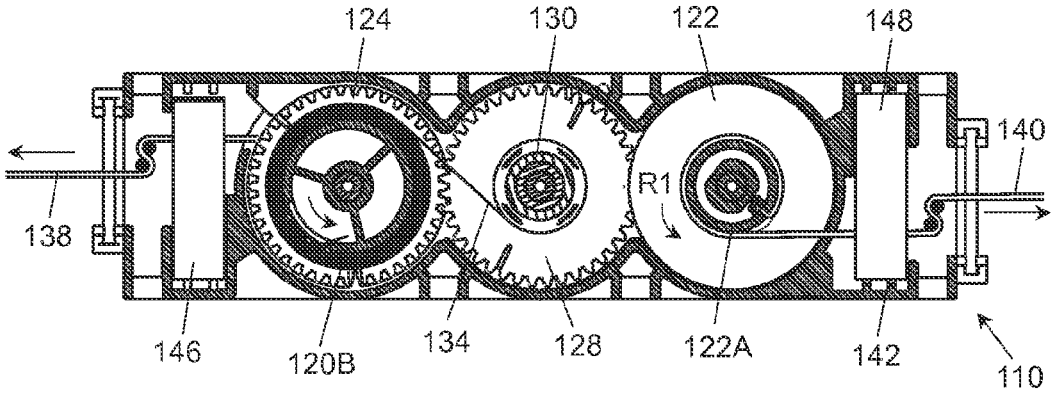
FIGS. 9B and 9C are cross-sectional views respectively taken along sections B and C as shown in FIG. 7 illustrating the spring drive system in a state corresponding to the position of the window shade shown in FIG. 9A.
Figure 9C:
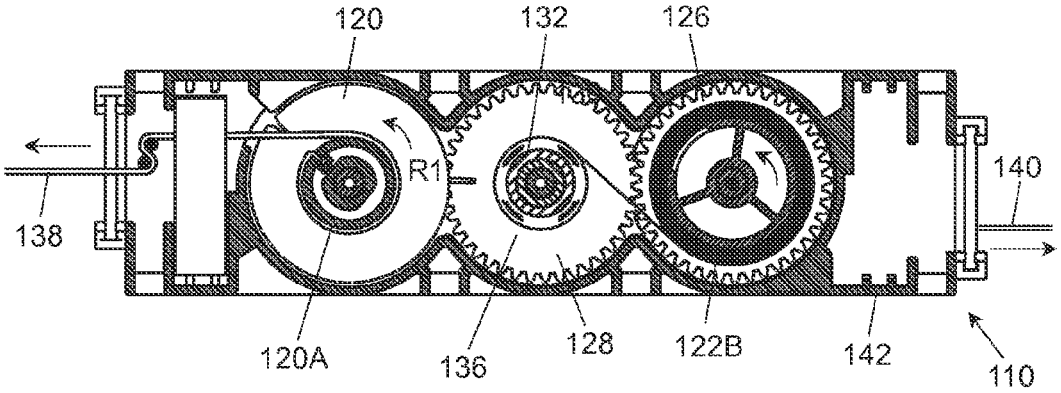

FIG. 9A is a schematic view illustrating the window shade 100 in another position in which the bottom part 106 is vertically lowered away from the head rail 102 to expand at least partially the shading structure 104. FIGS. 9B and 9C are cross-sectional views respectively taken along sections B and C as shown in FIG. 7 illustrating the spring drive system 110 in a state corresponding to the position of the window shade 100 shown in FIG. 9A. Referring to FIGS. 5-7 and 9A-9C, as an operator manually pulls the bottom part 106 downward away from the head rail 102, the suspension cords 138 and 140 respectively unwind from the drum surfaces 120A and 122A, which drives rotation of the rotary drums 120 and 122 about their respective pivot axes P1 and P2 in a same direction R1 whereas the gear 128 also rotates about the pivot axis P3 owing to the respective engagement between the gear 128 and the gears 124 and 126. As a result, the two springs 134 and 136 are pulled by the rotary drums 120 and 122 to respectively unwind from the spools 130 and 132 and respectively wind around the drum surfaces 120B and 122B. While the two springs 134 and 136 wind around the rotary drums 120 and 122, the spools 130 and 132 can respectively rotate about the pivot axis P3 relative to the gear 128 and the housing 118.

Once the bottom part 106 reaches a desired height and is released at the corresponding position, the biasing forces applied by the two springs 134 and 136 on the rotary drums 120 and 122 can counteract a weight exerted by the bottom part 106. As a result, the rotary drums 120 and 122 can be kept stationary, and the bottom part 106 can remain stationary at the desired position.

Figure 10A:
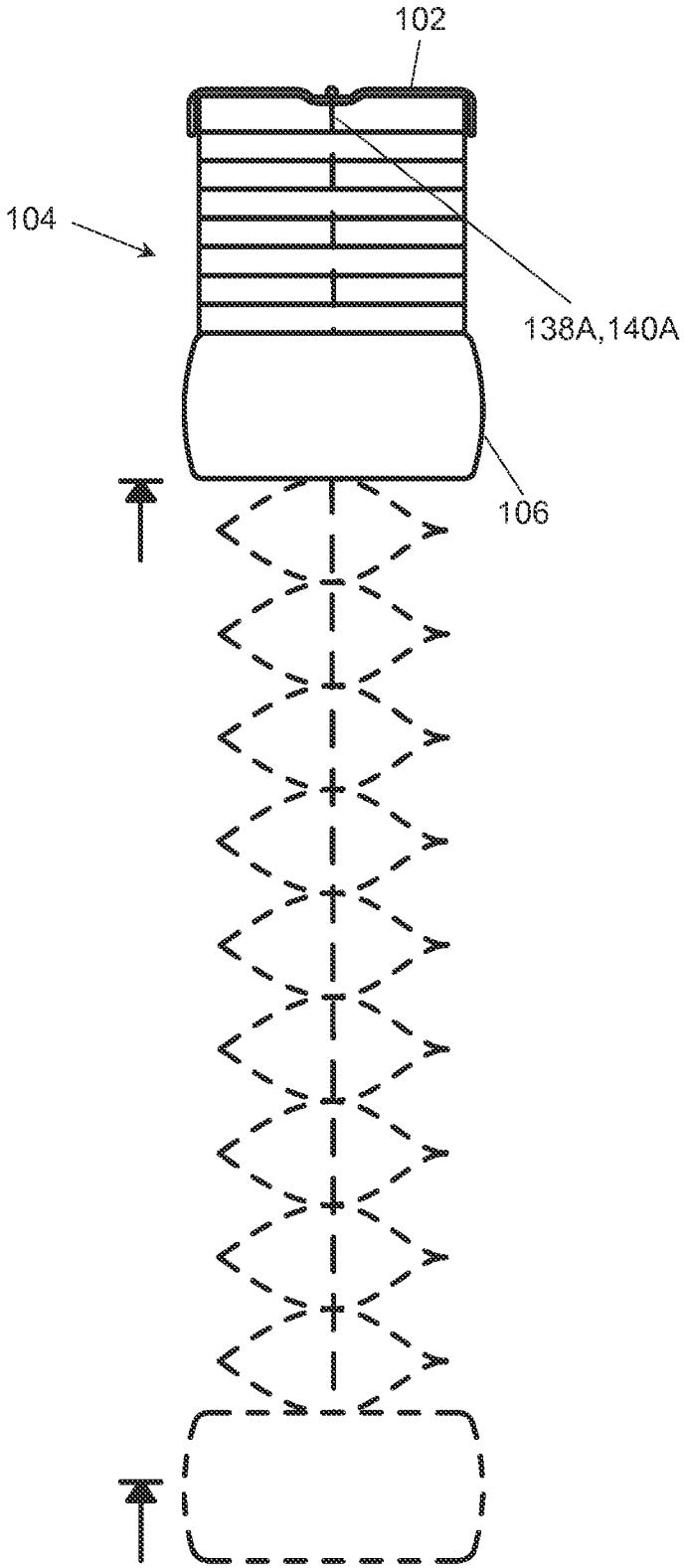
FIG. 10A is a schematic view illustrating the cordless window shade in a configuration in which the bottom part is vertically raised toward the head rail to collapse at least partially the shading structure.
Figure 10B:
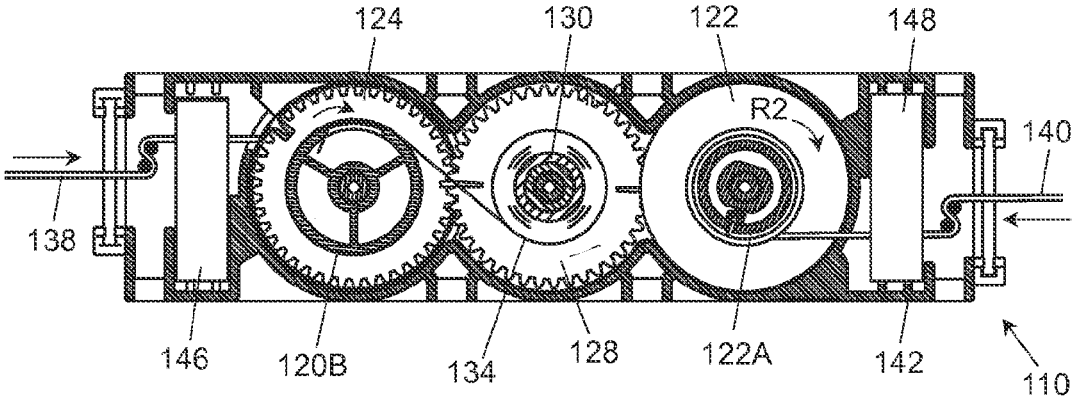
FIGS. 10B and 10C are cross-sectional views respectively taken along sections B and C as shown in FIG. 7 illustrating the spring drive system in a state corresponding to the configuration of the window shade shown in FIG. 10A.
Figure 10C:
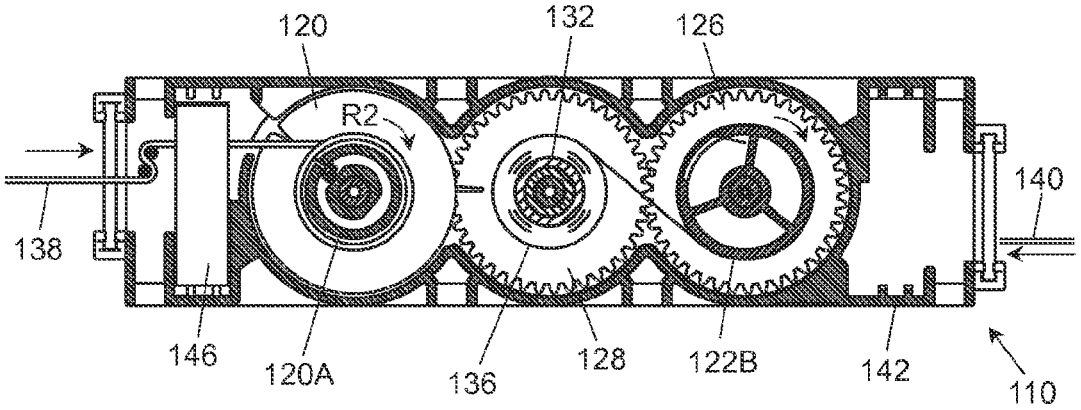

FIG. 10A is a schematic view illustrating the window shade 100 in a configuration in which the bottom part 106 is vertically raised toward the head rail 102 to collapse at least partially the shading structure 104. FIGS. 10B and 10C are cross-sectional views respectively taken along sections B and C as shown in FIG. 7 illustrating the spring drive system 110 in a state corresponding to the configuration of the window shade 100 shown in FIG. 10A. Referring to FIGS. 5-7 and 10A-10C, for raising the bottom part 106, an operator can manually push the bottom part 106 upward to collapse at least partially the shading structure 104. While the bottom part 106 rises toward the head rail 102, the two springs 134 and 136 respectively bias the two rotary drums 120 and 122 to rotate about their respective pivot axes P1 and P2 in a same direction R2 opposite to the direction R1 for respectively winding the slack of the two suspension cords 138 and 140 around the drum surfaces 120A and 122A. The pressure applied by the tensioning plates 146 and 148 can ensure that the suspension cords 138 and 140 are properly tensioned while they are wound around the rotary drums 120 and 122, which can prevent undesirable inclination of the bottom part 106. While the rotary drums 120 and 122 rotate to wind the suspension cords 138 and 140, the two springs 134 and 136 respectively unwind from the drum surfaces 120B and 122B of the rotary drums 120 and 122 and respectively wind around the spools 130 and 132. While the two springs 134 and 136 wind around the spools 130 and 132, the spools 130 and 132 can respectively rotate about the pivot axis P3 relative to the gear 128 and the housing 118.

Once the rising bottom part 106 reaches a desired height and is released at the corresponding position, the biasing forces applied by the two springs 134 and 136 on the rotary drums 120 and 122 can counteract a weight exerted by the bottom part 106 so that the bottom part 106 can be kept stationary at the desired position.

The spring drive system 110 described previously uses two springs 134 and 136 to sustain the bottom part 106 in position. It will be appreciated, however, that some variant embodiment may use one single spring for window shades having a smaller bottom part 106.

Figure 11:
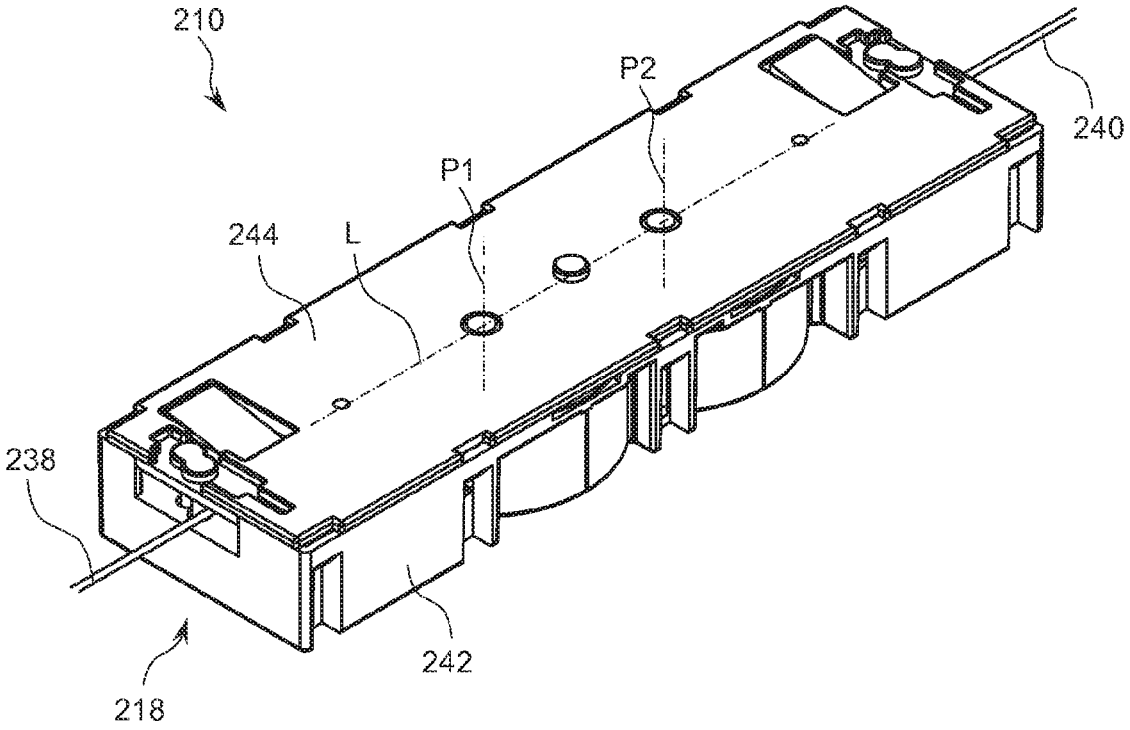
FIG. 11 is a perspective view illustrating another embodiment of a spring drive system that may be used in a cordless window shade.
Figure 12:
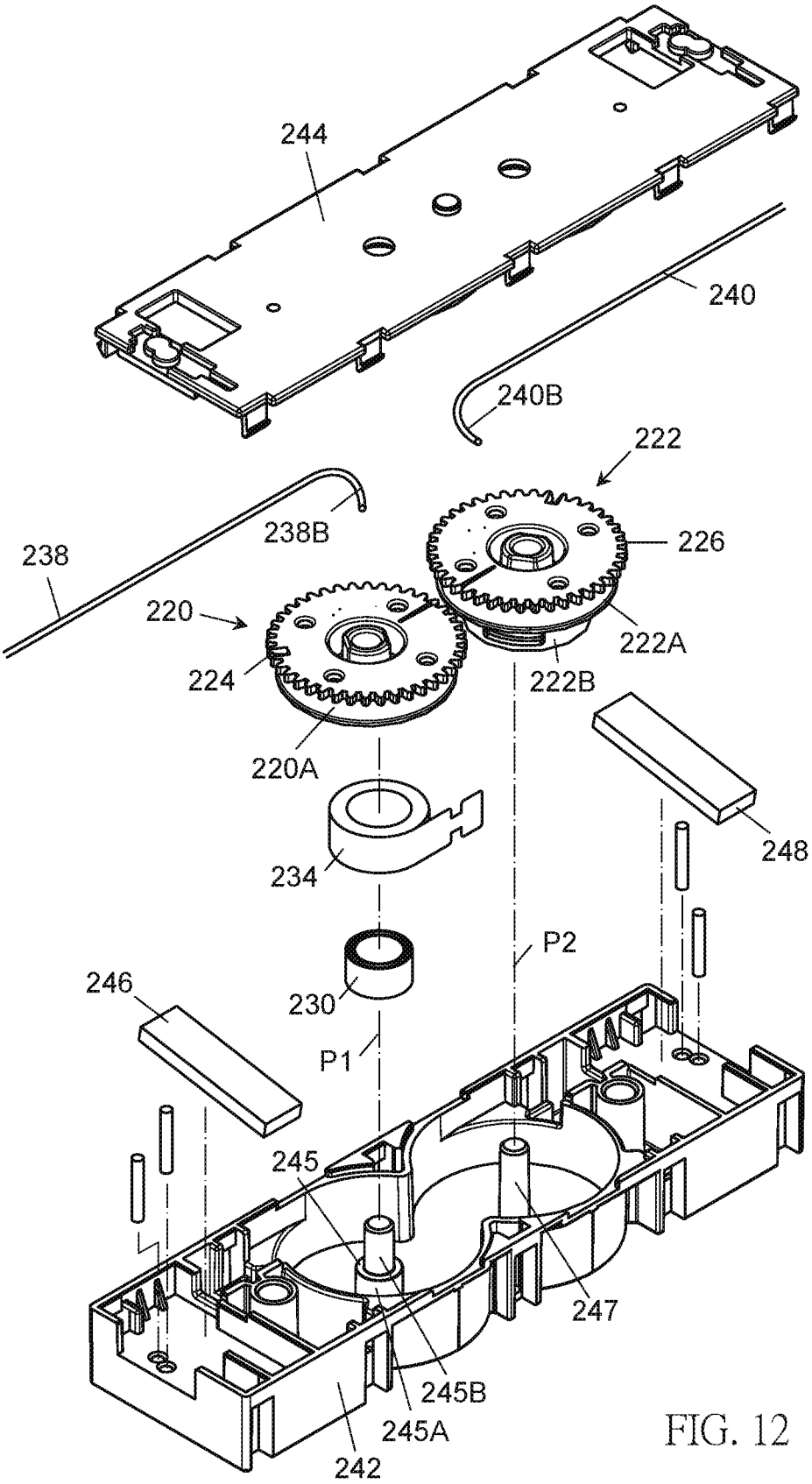
FIG. 12 is an exploded view illustrating the spring drive system shown in FIG. 11.
Figure 13:
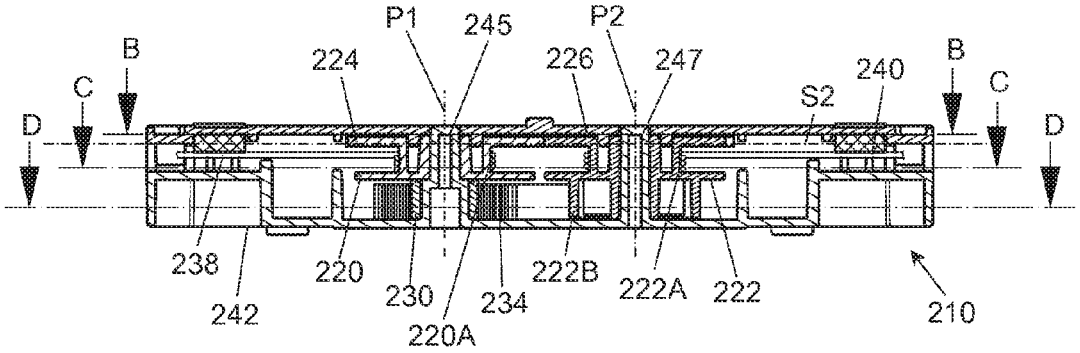
FIG. 13 is a cross-sectional view of the spring drive system shown in FIG. 11.

FIGS. 11-13 are schematic views illustrating a variant embodiment of an spring drive system 210 that can be arranged in the bottom part 106. The spring drive system 210 can include a housing 218, two rotary drums 220 and 222, two gears 224 and 226, a spool 230, a spring 234 and two suspension cords 238 and 240. The housing 218 can be affixed with the bottom part 106, and can be formed by a casing 242 and a lid 244. The casing 242 can have an inner cavity in which are respectively placed the rotary drums 220 and 222, the gears 224 and 226, the spool 230 and the spring 234.

The rotary drum 220 is affixed with the gear 224, and has a drum surface 220A at one side of the gear 224. The rotary drum 220 and the gear 224 can be pivotally connected with the housing 218 coaxially about a shaft 245 that is affixed with the casing 242. More specifically, the shaft 245 can have two sections 245A and 245B of different diameters, the diameter of the section 245A being larger than the diameter of the section 245B. The rotary drum 220 can be pivotally connected about the section 245B. The shaft 245 can thereby define a pivot axis P1 about which the rotary drum 220 and the gear 224 can rotate in unison relative to the housing 218.

The spool 230 can be pivotally connected about the section 245A of the shaft 245, and can be disposed coaxial to the rotary drum 220 and the gear 224. More specifically, the drum surface 220A of the rotary drum 220 is located between the gear 224 and the spool 230 after assembly of the rotary drum 220 and the spool 230 about the shaft 245. The spool 230 can rotate about the pivot axis P1 relative to the rotary drum 220 and the housing 218.

The rotary drum 222 is affixed with the gear 226 and has two drum surfaces 222A and 222B, the drum surface 222A being located between the gear 226 and the drum surface 222B. The rotary drum 222 and the gear 226 can be connected pivotally with the housing 218 coaxially about a shaft 247 that is affixed with the casing 242 spaced apart from the shaft 245. The shaft 247 can thereby define a pivot axis P2 about which the rotary drum 222 and the gear 226 can rotate in unison relative to the housing 218. Moreover, the gear 226 of the rotary drum 222 is meshed with the gear 224 of the rotary drum 220 in a plane S2, and the pivot axes P1 and P2 can be substantially perpendicular to the plane S2.

The suspension cord 238 vertically passes through the shading structure 104, and has two opposite ends 238A and 238B (the end 238A is better shown in FIG. 15A) respectively anchored with the head rail 102 and the drum surface 220A of the rotary drum 220. The suspension cord 240 likewise vertically passes through the shading structure 104, and has two opposite ends 240A and 240B (the end 240A is better shown in FIG. 15A) respectively anchored with the head rail 102 and the drum surface 222A of the rotary drum 222. The two suspension cords 238 and 240 respectively extend outside the housing 218 at a same side of a line L (better shown in FIG. 11) intersecting the two pivot axes P1 and P2 of the rotary drums 220 and 222. Owing to the engagement between the two gears 224 and 226, the two rotary drums 220 and 222 can rotate synchronously in opposite directions to respectively wind the suspension cords 238 and 240, which correspond to a rise of the bottom part 106. Moreover, the two rotary drums 220 and 222 can also rotate synchronously to respectively unwind the suspension cords 238 and 240, which correspond to a lowering displacement of the bottom part 106.

The spring 234 can be a ribbon spring, and can be assembled around the spool 230. The spring 234 can have two opposite ends respectively anchored with the spool 230 and the drum surface 222B of the rotary drum 222.

The spring 234 can unwind from the spool 230 and wind around the drum surface 222B of the rotary drum 222 when the two rotary drums 220 and 222 rotate to respectively unwind the two suspension cords 238 and 240. Moreover, the spring 234 can unwind from the rotary drum 222 and wind around the spool 230 to drive respective rotations of the two rotary drums 220 and 222 for respectively winding the two suspension cords 238 and 240.

Referring to FIG. 11, the spring drive system 210 can further include two tensioning plates 246 and 248 respectively arranged near the two rotary drums 220 and 222. The tensioning plates 246 and 248 can be biased (e.g., by spring action) to respectively press on the two suspension cords 238 and 240, whereby the suspension cords 238 and 240 can be properly tensioned when they are wound around the rotary drums 220 and 222.

The spring drive system 210 as described above can be arranged such that the gears 224 and 226 are placed generally horizontally in the bottom part 106 and the pivot axes P1 and P2 extend substantially vertical.

Figure 14A:
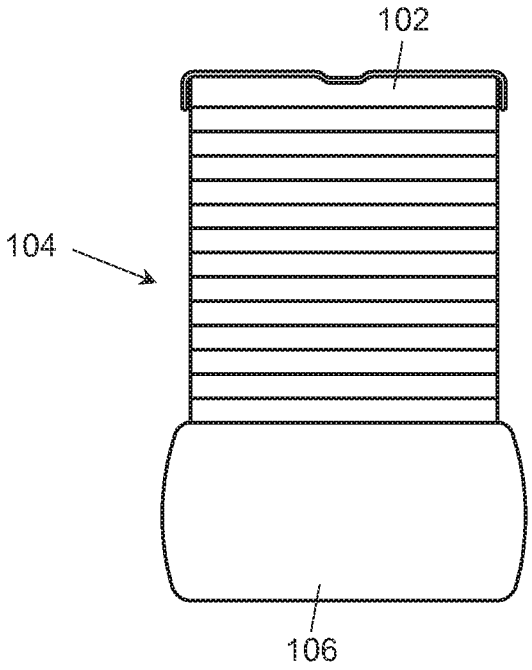
FIG. 14A is a schematic view illustrating a cordless window shade provided with the spring drive system of FIGS. 11-13 in a fully opened or raised state.
Figure 14B:
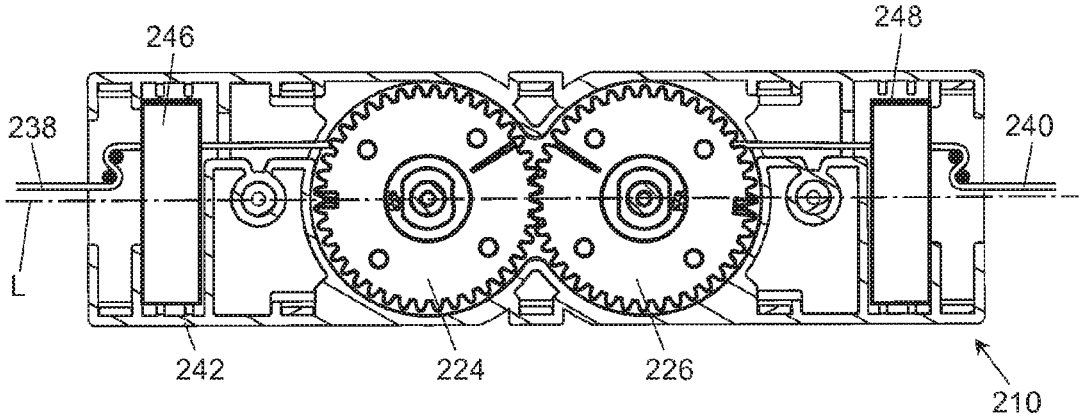
FIGS. 14B-14D are cross-sectional views respectively taken along sections B, C and D as shown in FIG. 13 illustrating the spring drive system in a state corresponding to the position of the cordless window shade shown in FIG. 14A.
Figure 14C:
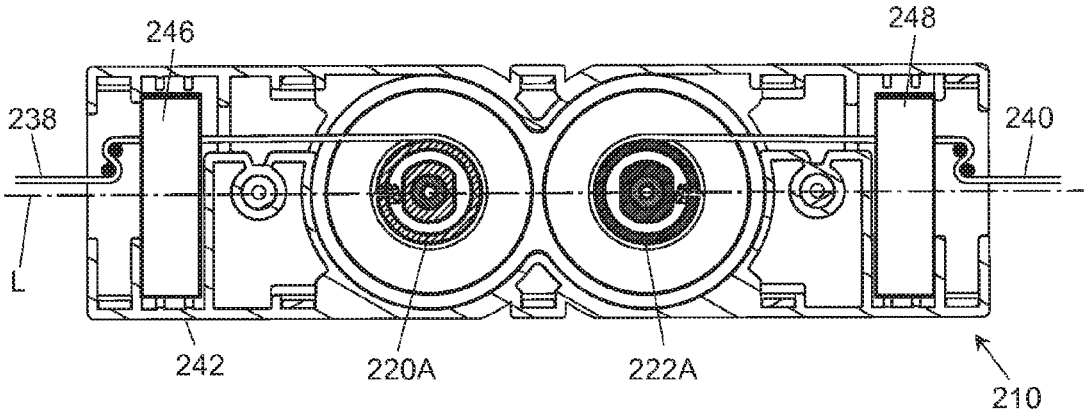
Figure 14D:
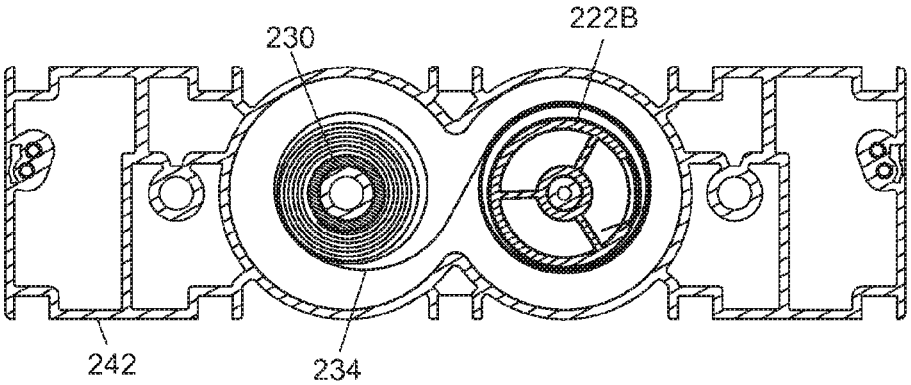

In conjunction with FIGS. 11-13, reference is made hereinafter to FIGS. 14A-16D to describe exemplary operation of the spring drive system 210. FIG. 14A is a schematic view illustrating the window shade 100 in a fully opened or raised state, and FIGS. 14B-14D are cross-sectional views respectively taken along sections B, C and D as shown in FIG. 13 illustrating the spring drive system 210 in a state corresponding to the configuration of the window shade shown in FIG. 14A. Referring to FIGS. 11-13 and 14A-14D, the window shade 100 is shown in a fully opened or raised state. In this state, the two suspension cords 238 and 240 are wound around the drum surfaces 220A and 222A of the rotary drums 220 and 222. Moreover, the spring 234 is substantially wound around the spool 230, and unwound from the drum surface 222B of the rotary drum 222. The biasing force applied by the spring 234 on the rotary drum 222 can counteract a weight exerted by the bottom part 106 so as to keep the two rotary drums 220 and 222 stationary. Accordingly, the bottom part 106 can remain in a stationary position close to the head rail 102, and the shading structure 104 can be collapsed between the head rail 102 and the bottom part 106.

Figure 15A:
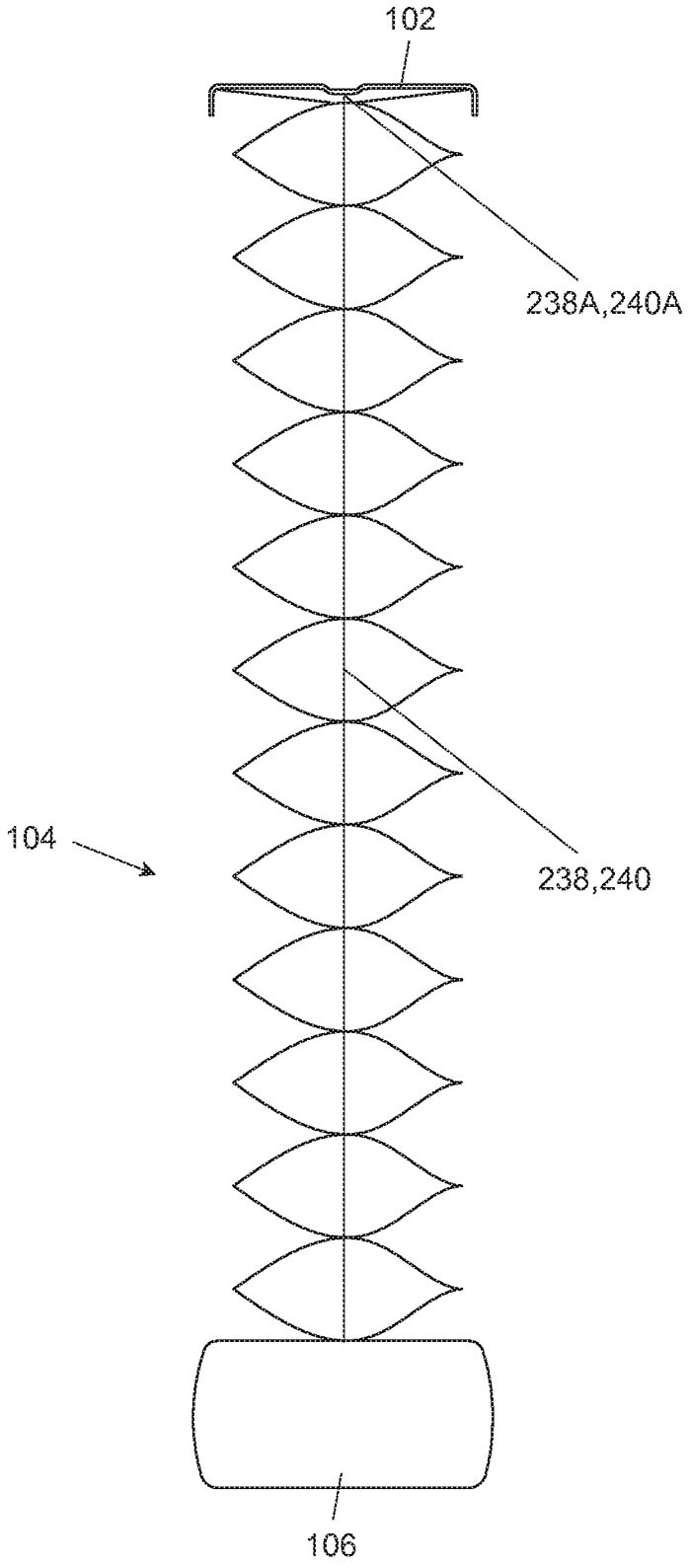
FIG. 15A is a schematic view illustrating the cordless window shade provided with the spring drive system of FIGS. 11-13 in another position in which the bottom part is vertically lowered away from the head rail to expand at least partially the shading structure.
Figure 15B:
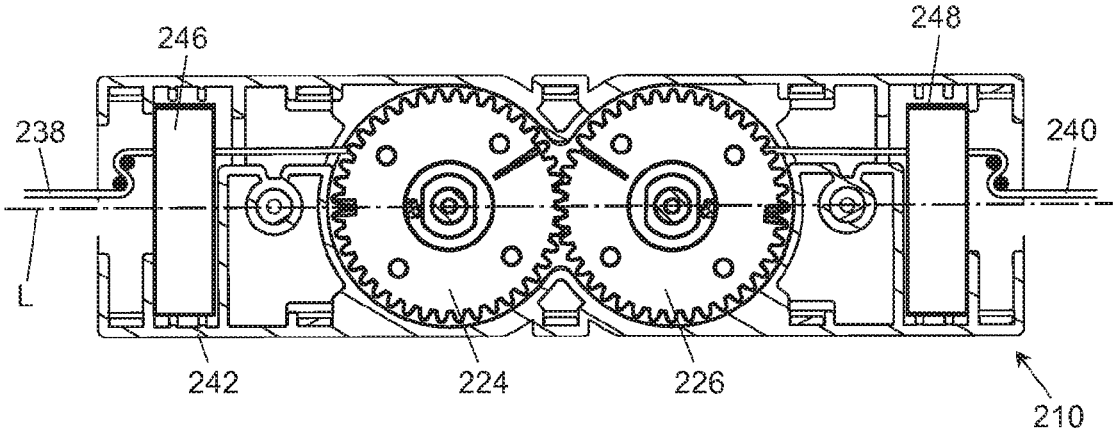
FIGS. 15B-15D are cross-sectional views respectively taken along sections B, C and D as shown in FIG. 13 illustrating the spring drive system in a state corresponding to the position of the cordless window shade shown in FIG. 15A.
Figure 15C:
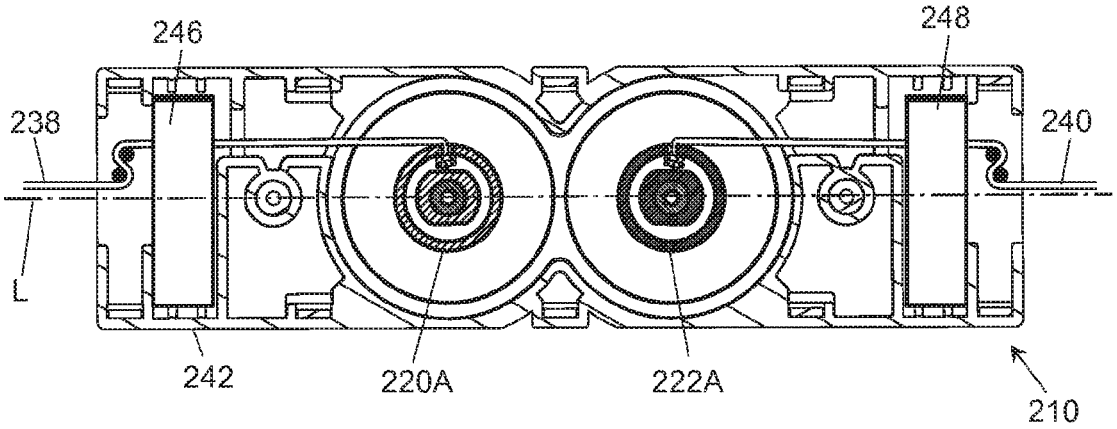
Figure 15D:
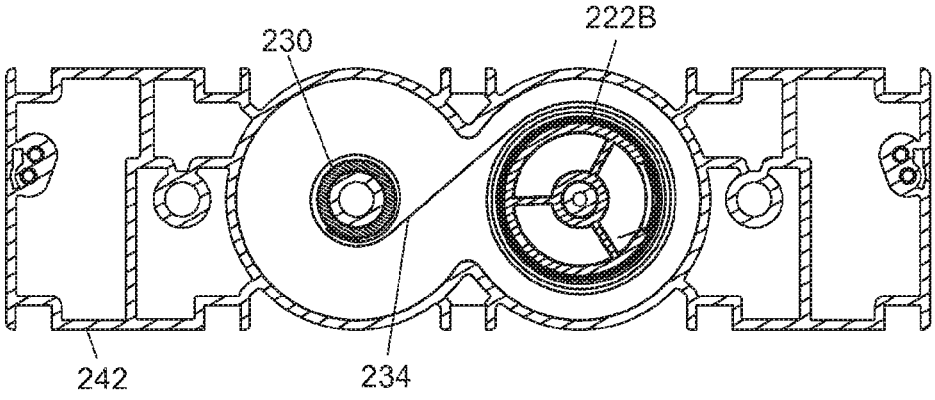

FIG. 15A is a schematic view illustrating the window shade 100 in another position in which the bottom part 106 is vertically lowered away from the head rail 102 to expand at least partially the shading structure 104. FIGS. 15B-15D are cross-sectional views respectively taken along sections B, C and D as shown in FIG. 13 illustrating the spring drive system 210 in a state corresponding to the position of the window shade 100 shown in FIG. 15A. Referring to FIGS. 11-13 and 15A-15D, as an operator manually pulls the bottom part 106 downward away from the head rail 102, the suspension cords 238 and 240 respectively unwind from the drum surfaces 220A and 222A, which drives rotation of the rotary drums 220 and 222 about their respective pivot axes P1 and P2 in opposite directions. As a result, the spring 234 is pulled by the rotary drum 222 to unwind from the spool 230 and wind around the drum surface 222B. While the spring 234 winds around the rotary drum 222, the spool 230 can rotate about the pivot axis P1 relative to the rotary drum 220 and the housing 218.

Once the bottom part 106 reaches a desired height and is released at the corresponding position, the biasing force applied by the spring 234 on the rotary drum 222 (which may be transmitted to the rotary drum 220 via the engagement between the gears 224 and 226) can counteract a weight exerted by the bottom part 106. As a result, the rotary drums 220 and 222 can be kept stationary, and the bottom part 106 can remain stationary at the desired position.

Figure 16A:
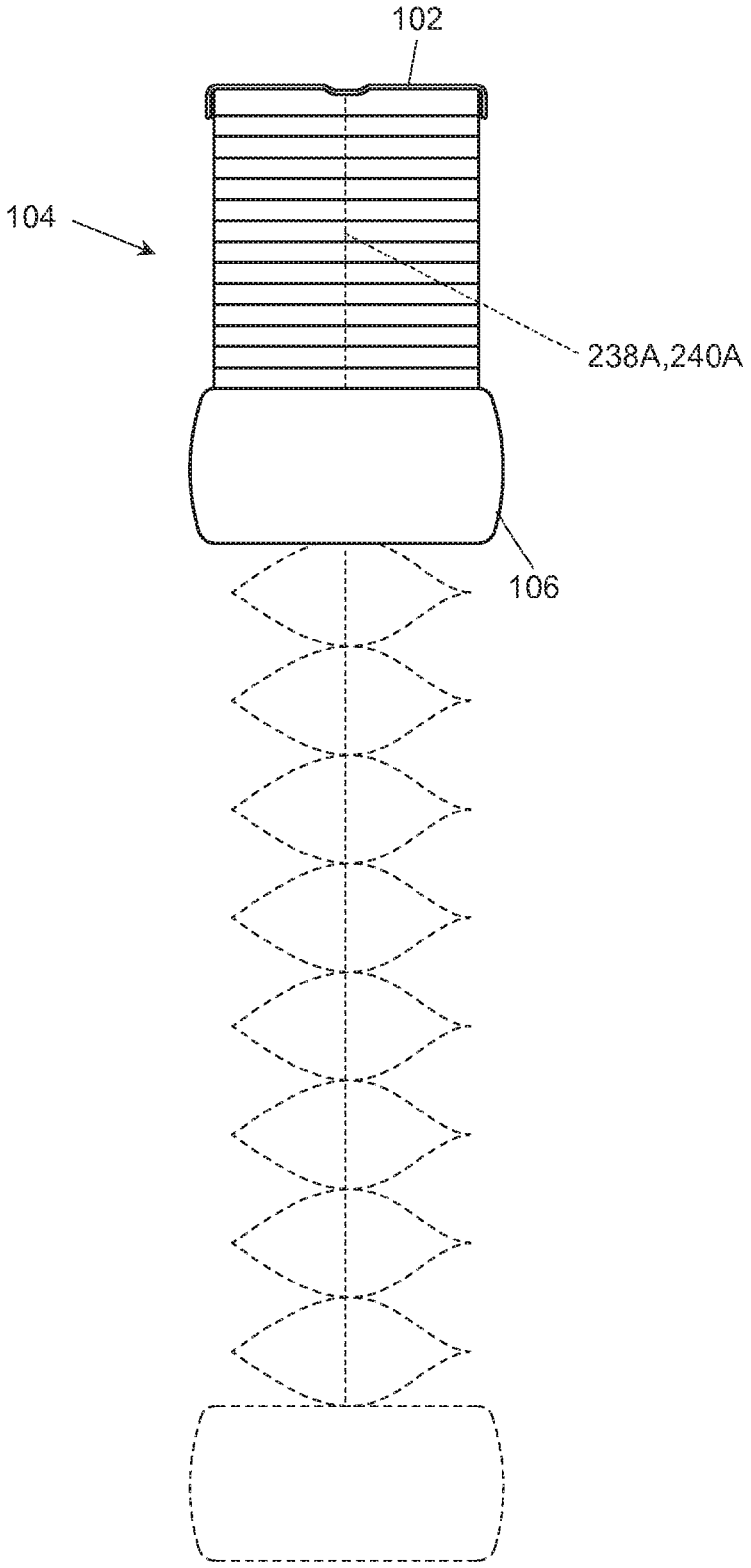
FIG. 16A is a schematic view illustrating the cordless window shade provided with the spring drive system of FIGS. 11-13 in a configuration in which the bottom part is vertically raised toward the head rail to collapse at least partially the shading structure.
Figure 16B:
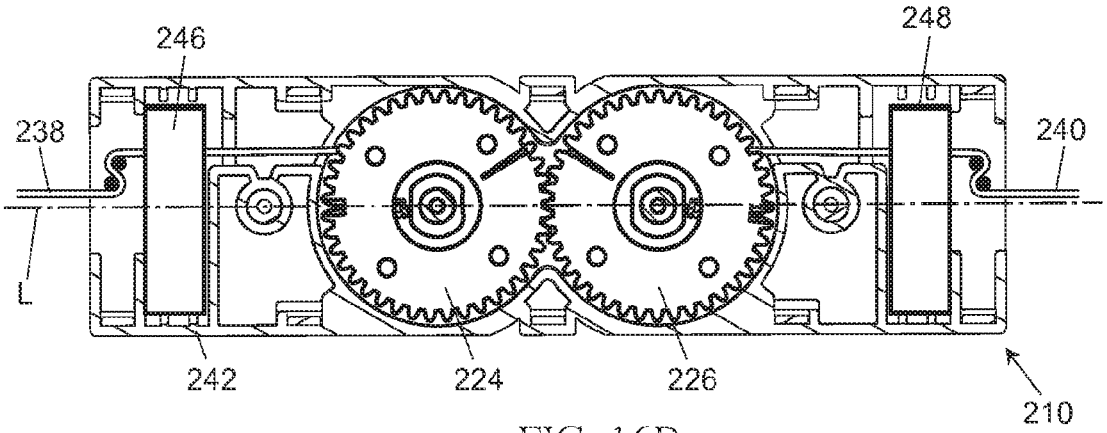
FIGS. 16B-16D are cross-sectional views respectively taken along sections B, C and D as shown in FIG. 13 illustrating the spring drive system in a state corresponding to the configuration of the window shade shown in FIG. 16A.
Figure 16C:
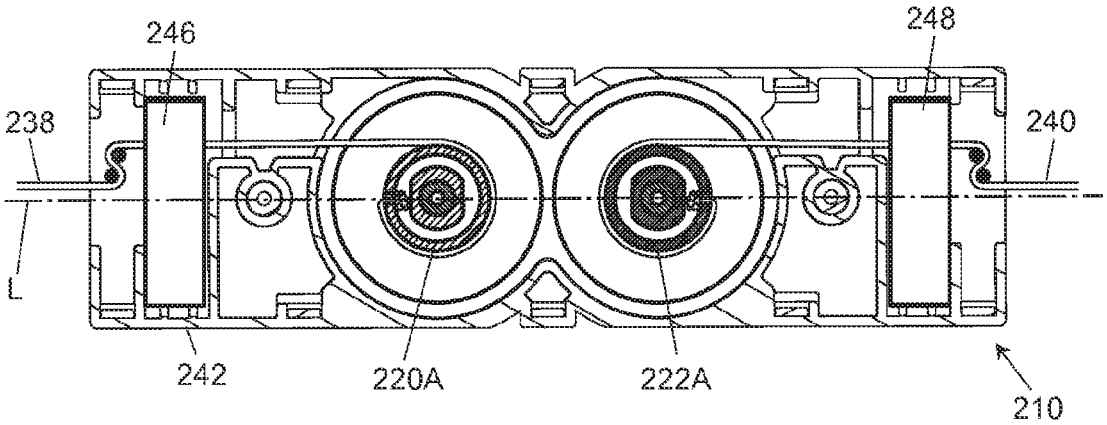
Figure 16D:
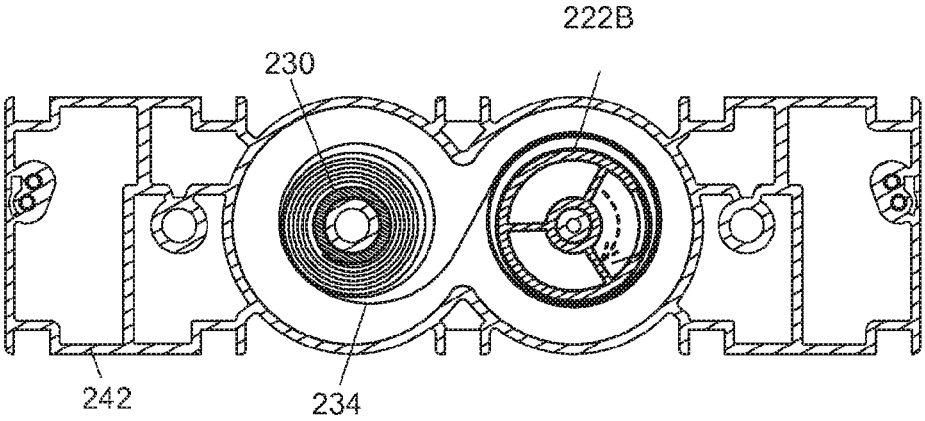

FIG. 16A is a schematic view illustrating the window shade 100 in a configuration in which the bottom part 106 is vertically raised toward the head rail 102 to collapse at least partially the shading structure 104. FIGS. 16B-16D are cross-sectional views respectively taken along sections B, C and D as shown in FIG. 13 illustrating the spring drive system 210 in a state corresponding to the configuration of the window shade 100 shown in FIG. 16A. Referring to FIGS. 11-13 and 16A-16D, for raising the bottom part 106, an operator can manually push the bottom part 106 upward to collapse at least partially the shading structure 104. While the bottom part 106 rises toward the head rail 102, the spring 234 biases the rotary drum 222 to rotate about the pivot axis P2 for winding the slack of the suspension cord 240 around the drum surface 222A, which in turn can urge the rotary drum 220 to rotate about the pivot axis P1 for winding the slack of the suspension cord 238 around the drum surface 220A owing to the engagement between the gears 224 and 226. The pressure applied by the tensioning arms 246 and 248 can ensure that the suspension cords 238 and 240 are properly tensioned while they are wound around the rotary drums 220 and 222, which can prevent undesirable inclination of the bottom part 106. While the rotary drums 220 and 222 rotate to wind the suspension cords 238 and 240, the spring 234 unwinds from the drum surface 222B of the rotary drum 222 and winds around the spool 230. While the spring 234 winds around the spool 230, the spool 230 can rotate about the pivot axis P1 relative to the rotary drum 220 and the housing 218.

Once the rising bottom part 106 reaches a desired height and is released at the corresponding position, the biasing force applied by the spring 234 on the rotary drum 222 can counteract a weight exerted by the bottom part 106 so that the bottom part 106 can be kept stationary at the desired position.

The spring drive systems described herein can be implemented in a cost-effective manner, and can connect springs directly to the rotary drums of the suspension cords. In particular, the spring drive systems require less components parts and are compact in size, which can advantageously reduce the overall weight of the bottom part in which the spring drive system is assembled. This can facilitate manual operation of the bottom part for collapsing or expanding the window shade.

Realizations of the structures have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. A spring drive system for a window shade, comprising:

a housing;

a first rotary drum affixed with a first gear and pivotally connected with the housing, the first rotary drum being connected with a first suspension cord;

a second rotary drum affixed with a second gear and pivotally connected with the housing, the second rotary drum being connected with a second suspension cord;

a third gear pivotally connected with the housing, the third gear being respectively meshed with the first and second gears;

a first and a second spool respectively pivotally connected at two opposite sides of the third gear, the first and second spools being arranged coaxial to the third gear and respectively rotatable relative to the third gear; and a first spring having a first and a second end respectively anchored with the first rotary drum and the first spool, and a second spring having a third and a fourth end respectively anchored with the second rotary drum and the second spool;

wherein the first and second springs respectively unwind from the first and second spools and respectively wind around the first and second rotary drums when the first and second rotary drums rotate to respectively unwind the first and second suspension cords therefrom, and the first and second springs respectively unwind from the first and second rotary drums and respectively wind around the first and second spools to drive respective rotations of the first and second rotary drums for respectively winding the first and second suspension cords.

2. The spring drive system according to claim 1, wherein the first rotary drum has a first and a second drum surface at two opposite sides of the first gear that are respectively connected with the first suspension cord and the first spring, the second rotary drum has a third and a fourth drum surface at two opposite sides of the second gear that are respectively connected with the second suspension cord and the second spring.

3. The spring drive system according to claim 2, wherein the third gear is respectively meshed with the first and second gears in a common plane, the first drum surface is located at a first side of the common plane, and the third drum surface is located at a second side of the common plane.

4. The spring drive system according to claim 1, wherein the third gear is affixed with a first and a second shaft portion at two opposite sides, and the first and second spools are respectively connected pivotally about the first and second shaft portions.

5. The spring drive system according to claim 1, wherein the first rotary drum and the first gear are rotatable relative to the housing about a first pivot axis, the second rotary drum and the second gear are rotatable relative to the housing about a second pivot axis, and the third gear is rotatable relative to the housing about a third pivot axis, the first through third pivot axes are substantially aligned along a same line.

6. The spring drive system according to claim 5, wherein the first suspension cord extends from the first rotary drum at a first side of the line, and the second suspension cord extends from the second rotary drum at a second side of the line.

7. The spring drive system according to claim 1, further including a first and a second tensioning plate respectively arranged near the first and second rotary drum, the first and second tensioning plates respectively pressing on the first and second suspension cords.

8. The spring drive system according to claim 1, wherein the first and second springs are ribbon springs.

9. A cordless window shade comprising:

a headrail;

a shading structure having an upper and a lower end, the upper end being connected with the headrail;

a bottom part connected with the lower end of the shading structure; and the spring drive system according to claim 1, the housing of the spring drive system being affixed with the bottom part, the first and second suspension cords having ends respectively affixed with the headrail, the first and second springs of the spring drive system being configured to counteract a weight applied on the bottom part to sustain the bottom part in a stationary position.

10. The cordless window shade according to claim 9, wherein the first and second springs respectively bias the first and second rotary drums to rotate for respectively winding the first and second suspension cords when the bottom part rises toward the headrail.

11. The cordless window shade according to claim 10, wherein the first, second and third gears are placed generally horizontally in the bottom part.

* * * * *